US006990827B2

(12) United States Patent
Antognoni

(10) Patent No.: US 6,990,827 B2
(45) Date of Patent: Jan. 31, 2006

(54) ICE MAKING APPARATUS FOR MARINE VESSELS

(76) Inventor: Bruce Elliot Antognoni, 4913 SW. 32nd Ter., Ft. Lauderdale, FL (US) 33312

( * ) Notice: Subject to any disclaimer, the term of this patent is extended or adjusted under 35 U.S.C. 154(b) by 363 days.

(21) Appl. No.: 10/281,198

(22) Filed: Oct. 28, 2002

(65) Prior Publication Data

US 2004/0079104 A1 Apr. 29, 2004

(51) Int. Cl.
*F25C 1/14* (2006.01)

(52) U.S. Cl. ..... 62/354; 62/506

(58) Field of Classification Search ..... 62/305, 62/354, 506

See application file for complete search history.

(56) References Cited

U.S. PATENT DOCUMENTS 3,233,417 A * 2/1966 Soderberg ..... 62/233
3,274,792 A * 9/1966 Weil et al. ..... 62/138
3,333,436 A * 8/1967 Johnson et al. ..... 62/123
3,342,040 A * 9/1967 Dedricks et al. ..... 62/320
3,371,505 A * 3/1968 Raver et al. ..... 62/320
4,771,609 A * 9/1988 Funabashi ..... 62/137
5,109,679 A * 5/1992 Hida ..... 62/320
5,974,823 A * 11/1999 Banno et al. ..... 62/354
6,009,718 A * 1/2000 Ikari et al. ..... 62/354
6,257,009 B1 * 7/2001 Tsuchikawa ..... 62/233
2003/0159458 A1 * 8/2003 Fang et al. ..... 62/305

* cited by examiner

*Primary Examiner*—William E. Tapolcai

(57) ABSTRACT

An ice maker for marine vessels having an evaporator assembly within which ice is formed for delivery to remote locations. An air and water cooled condensing unit delivers refrigeration fluid to the evaporator assembly and ice formed therein is driven by an auger into a distribution chamber defined by a distribution cap member located above the auger. Ice entering the distribution chamber passes through a comminution ring which breaks the ice up into smaller particles and the ice is then directed radially by a slanted wall into the blades of an impeller member which rotates about the same axis as the auger and which drives the ice particles into a discharge opening formed in the ice distribution cap. The evaporator assembly and the condensing unit are mounted separately so that the evaporator assembly may be located to reduce the path through which the ice must travel to reach its ultimate destination.

19 Claims, 4 Drawing Sheets

ICE MAKING APPARATUS FOR MARINE VESSELS

BACKGROUND OF THE INVENTION

The present invention relates generally to ice making apparatus for marine vessels, and more particularly to apparatus which is capable of delivering ice to locations on the marine vessel spaced from the ice making apparatus.

Devices of the type to which the present invention relates can encounter difficulties with regard to reliability of operation since the ice must be driven through elongated delivery conduits to its ultimate destination. An auger or extruder mechanically drives the ice through a freezing chamber to an outlet from which the ice must be forced into and through the delivery conduits.

Ice leaving the extruder or auger must usually undergo a change in direction before it can pass to the outlet and through the delivery conduits. This can cause a problem because the ice may tend to accumulate before reaching the ice outlet thereby jamming the device and requiring shut down of the apparatus. Since the auger must continuously drive ice particles through the outlet, accumulation of ice particles can make continued operation of the auger impossible.

Usually, ice leaving the upper end of the auger has imparted thereto a vertically or axially directed force. However, before the ice can pass through the discharge opening it must undergo a change of direction of 90° or more thereby causing the ice to accumulate and jam the evaporator unit.

Furthermore, the need to deliver ice to remote locations can cause problems depending upon the distance through which the ice must travel since the auger alone may be unable to impart sufficient driving force for the ice to reach its ultimate destination.

Accordingly, it is an object of the present invention to provide marine ice making apparatus involving an auger driven ice making assembly which can provide smoother operation and operate more reliably substantially reducing the tendency of the apparatus to jam.

A further object of the invention is to provide a split system wherein a refrigeration assembly for providing refrigeration fluid and an evaporator assembly which includes an auger rotating within a freezing chamber or the like may be installed separated from each other thereby allowing more flexibility in the installation of the apparatus whereby the evaporator unit may be placed closer to the ultimate destination of the ice units to reduce the distance between the evaporator unit and the ice delivery location.

An additional object of the invention is to provide means for fragmentizing the ice particles leaving the end of the auger in order to facilitate moving the ice units into and through the delivery conduits.

A still further object of the invention is to provide means in addition to the auger to impart an additional delivery force to the ice units directed more in line with the direction in which the ice units must travel as they exit the evaporator unit into the delivery conduits.

SUMMARY OF THE INVENTION

Briefly, the present invention may be described as a marine ice making assembly including a refrigeration unit and an evaporator unit which may be mounted apart in order to provide flexibility in the placement of the apparatus thereby to reduce the distance through which ice must travel to reach its ultimate destination on the marine craft. The evaporator unit includes a freezing chamber surrounded by refrigeration coils which receive refrigeration fluid from the refrigeration unit in order to freeze water introduced into the freezing chamber. The ice units thus formed are driven through the freezing chamber by an auger rotating about a central axis into a distribution chamber located at the upper end of the freezing chamber.

In accordance with the present invention, the distribution chamber is defined by a concave ice distribution cap affixed to the top of the evaporator unit and defining an ice discharge opening which extends generally transversely to the axis of the auger. Ice units propelled by the auger enter the distribution chamber through a slotted comminution ring which operates to break the ice units into smaller pieces.

Located within the distribution cap is an upper bearing housing enclosing a bearing member for the auger and defining a slanted annular deflection surface which acts to divert the ice particles passing through the comminution ring in a direction radially outwardly relative to the axis of the auger. A slotted collar surrounding the comminution ring diverts the ice fragments upwardly toward the slanted annular surface.

Mounted atop the bearing housing is an impeller member having impeller blades which extend axially within the distribution chamber and which operate to drive the ice particles into the ice discharge opening upon rotation of the impeller member about the axis of the auger. Thus, the impeller blades operate to impart to the ice particles a force generally in alignment with the direction in which the ice units must travel in order to pass through the ice discharge opening thereby greatly reducing the tendency of the ice making assembly to clog or jam.

In accordance with a preferred embodiment of the invention, the impeller member should be formed of stainless steel to improve performance and reliability of operation.

Furthermore, the ice discharge opening in the ice discharge cap maybe formed to extend either in a direction radially outwardly from the axis of the auger or in a direction tangentially or circumferentially of the direction of rotation of the impeller blades.

DESCRIPTION OF THE DRAWINGS

Referring now to the drawings, wherein like reference numerals are used to refer to similar parts throughout the various figures thereof.

DETAILED DESCRIPTION OF THE PREFERRED EMBODIMENTS

Figure 1:
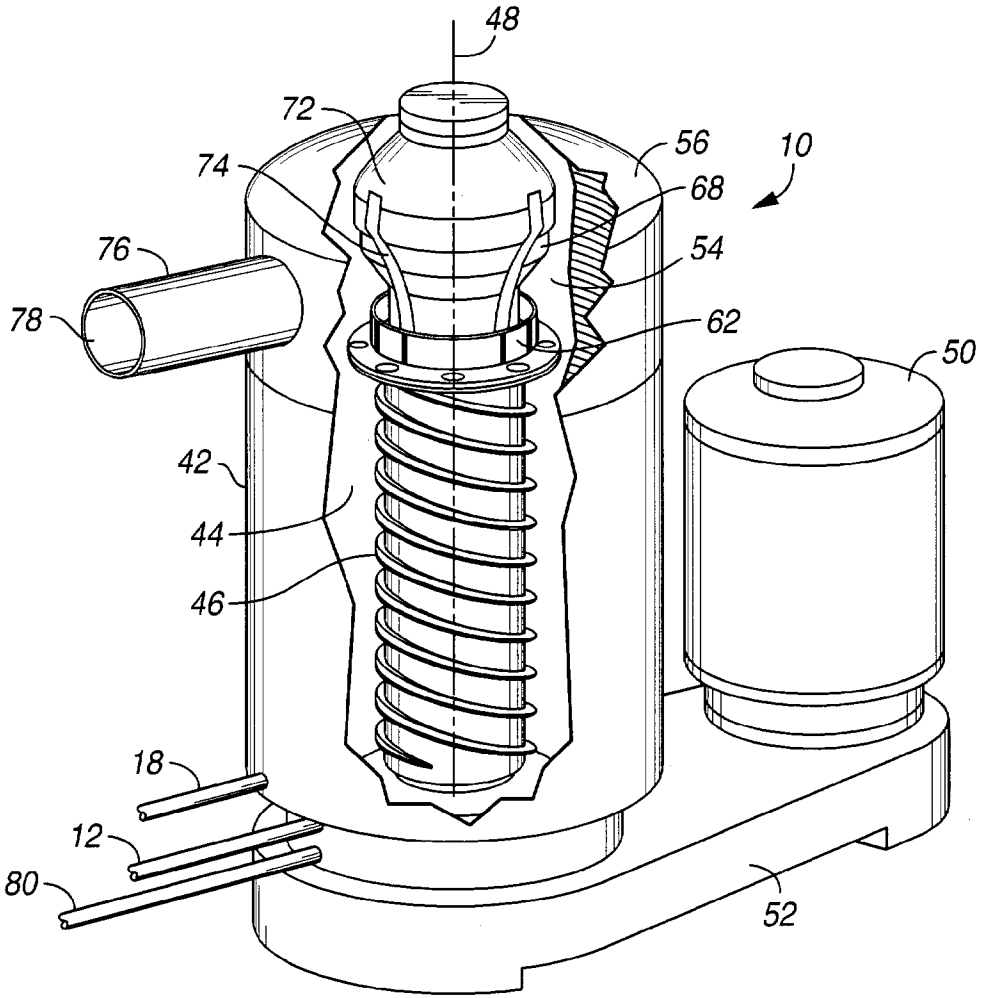
FIG. 1 is a perspective view partially broken away showing the evaporator unit in accordance with the present invention.
Figure 3:
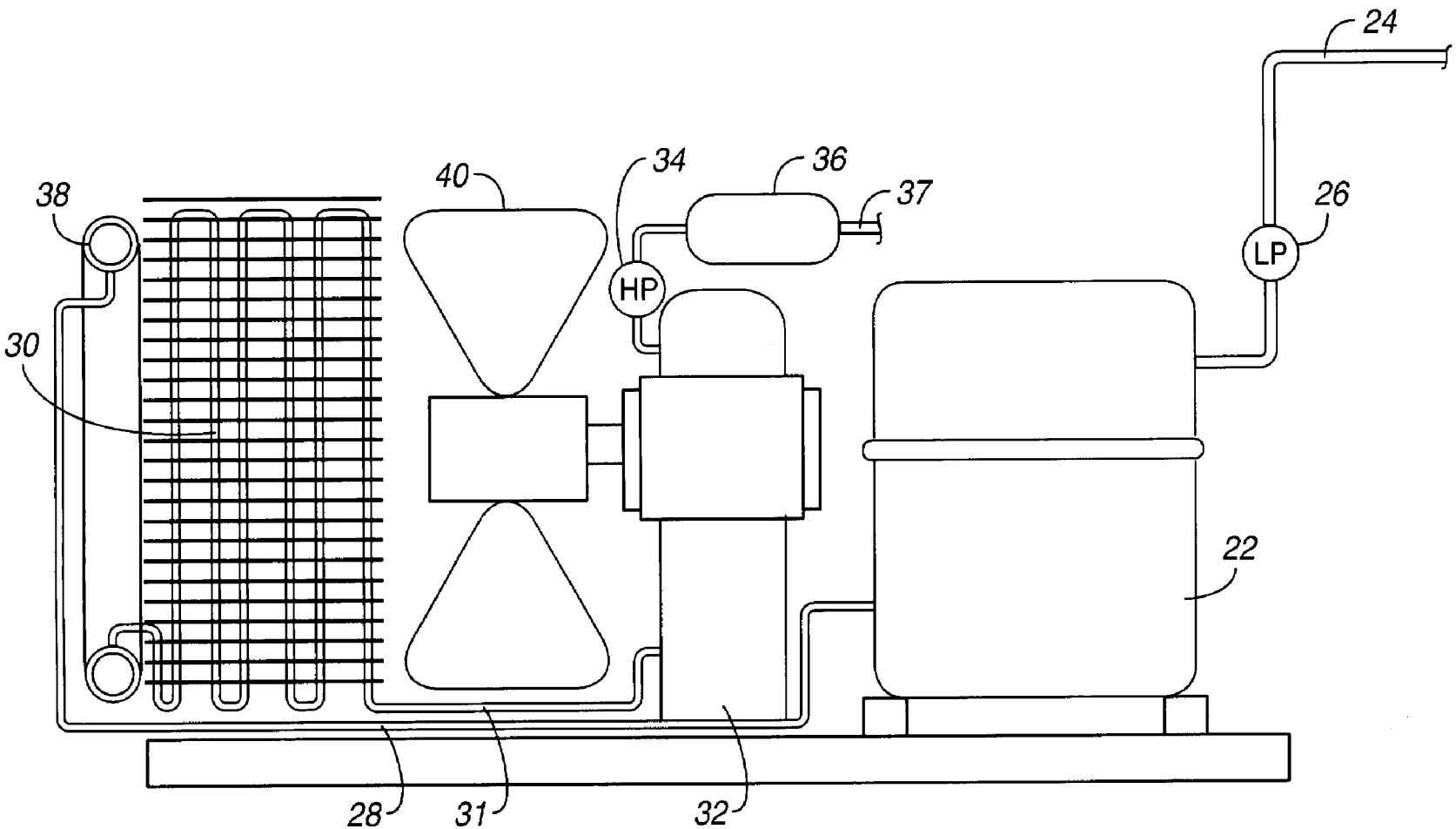
FIG. 3 is a schematic diagram showing a refrigeration or condensing unit which may be used in the present invention.
Figure 4:
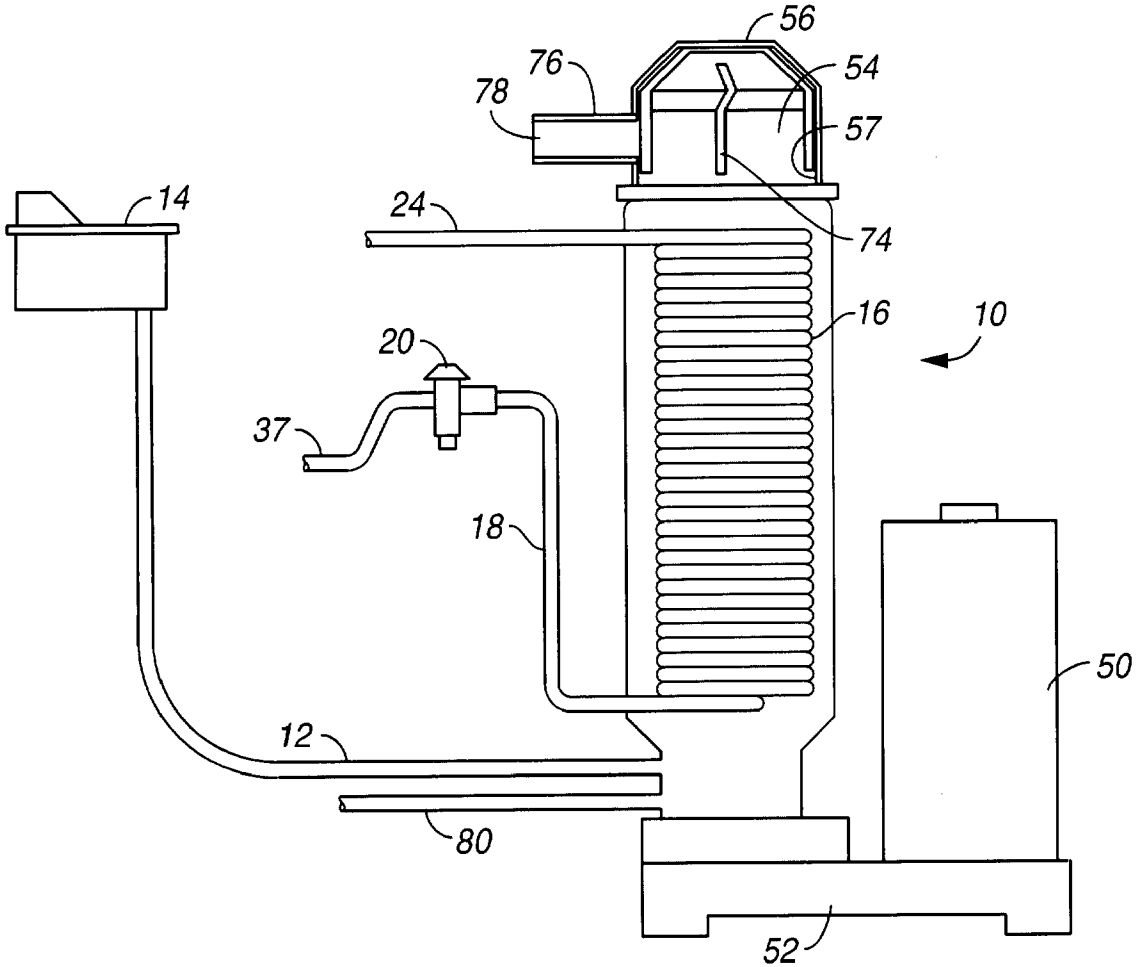
FIG. 4 is a schematic diagram showing the evaporator assembly including an evaporator unit in accordance with the present invention.

Referring now to the drawings, and more particularly to FIGS. 1 and 4, there is shown an evaporator unit 10 in accordance with the present invention within which ice units are formed. The evaporator unit 10 is part of an evaporator assembly, shown schematically in FIG. 4, which is connected to operate in cooperation with a condenser assembly shown schematically in FIG. 3.

In the operation of the device of the invention, fresh or salt water is introduced into the evaporator unit 10 through a water supply conduit 12 which receives fresh or salt water from a reservoir 14. It should be understood that when mounted on a marine vessel, the water supplied to the evaporator unit 10 may be ambient sea water if salt water ice is to be produced. Salt water ice would most likely be used on fishing vessels to store fish and the evaporator unit 10 would, of course, be made of corrosion resistant material, such as stainless steel. Furthermore, as will be apparent to those skilled in the art, the condenser or refrigeration assembly shown in FIG. 3 would have to be of the type which could produce temperatures in the evaporator unit 10 which could freeze salt water.

The unit 10 includes refrigeration coils 16 which receive high pressure liquid refrigerant from the condenser assembly of FIG. 3 through a refrigerant line 18 connected with a thermostatic expansion valve 20.

Refrigerant flowing through the coils 16 is returned to a compressor 22 of the condenser assembly of FIG. 3 as a low pressure gas through a suction line 24 and a low pressure control 26 where it is compressed to a high pressure gas and then directed through a line 28 to condensing unit 30 which converts the gas to a high pressure liquid.

The high pressure liquid is then returned from the condensing unit 30 to the coils 16 of the evaporator unit 10 by way of a line 31 through a receiver or storage chamber 32, a high pressure control 34, which senses the condensing temperature, and a liquid line dryer 36 which operates as a desiccant means to remove unwanted water. It should be noted that a line 37 connects the liquid line dryer 36 with the expansion valve 20 of the evaporator assembly.

The condensing unit 30 is an air cooled condenser with a water assist mechanism 38 which enables the unit 30 to operate more efficiently in a high ambient temperature environment. Particularly in marine applications, air cooling alone may not be sufficient due to high ambient temperatures and thus a water cooled assist is important. However, when lower ambient temperatures are in effect, such as when the marine vessel is docked or when the engines are not operating, the water assist cooling may be shut off and the device operated by air cooling alone to avoid introduction of sea weed and other contaminants into the water cooling system, which would be particularly problematic when the unit is unattended.

As shown in FIG. 3, the condensing unit includes a fan and motor assembly 40 which operates to cool the condenser 30 and which functions as the main cooling mechanism for the unit.

The evaporator assembly of FIG. 4 should not be placed in the engine room of the marine craft since the heat of the engine will interfere with optimum functioning of the evaporator unit 10. Thus, in accordance with one important aspect of the present invention, the condensing unit and the evaporator assembly are mounted separately on the marine craft and placed in different locations thus constituting a split system.

The evaporator unit of the invention is best seen in FIG. 1 as comprising an outer insulating shell 42 surrounding a freezing chamber 44 within which a rotating auger 46 is mounted. The auger 46 is driven to rotate about a central axis 48 by a motor assembly 50 mounted together with the evaporator unit 10 upon a base 52.

Water is introduced into the freezing chamber 44 through the conduit 12 from a water reservoir 14 with the water being turned into ice therein through the freezing effect of the coils 16. As previously stated, the water may be fresh potable water or salt water depending upon the desired application. Of course, as will be apparent to those skilled in the art, the unit must be flushed out when converting from salt water use to fresh water.

As the water turns to ice, the ice is driven upwardly by rotation of the auger 46 into an ice distribution chamber 54 defined within an ice distribution cap 56 detachably mounted atop the evaporator unit 10. A drain 80 is provided at the bottom of the evaporator unit 10 as a runoff for excess water.

Located within the chamber 54 is a comminution ring 58 having a series of slots 60 through which ice is driven by the auger 46 before entering distribution chamber 54. The slots 60 operate to break the ice units entering the chamber 54 into smaller particles to facilitate further passage of the ice to its ultimate destination.

A slotted collar 62 extending around the comminution ring 58 and mounted on a ring 63 operates to direct ice passing through the slots 60 upwardly. Holes 64 and 66 formed in the collar 62 and the ring 63, respectively, are adapted to receive connecting means such as bolts (not shown) to attach the collar 62 to the ring 63.

Located within the chamber 54 is an upper bearing housing 68 within which is located an upper bearing mechanism (not shown) for the auger 46. The bearing housing 68 is configured to define a slanted annular wall 70 which acts to divert in a radially outward direction ice particles passing through the slots 60 in the ring 58.

Mounted on the bearing housing 68 is an impeller member 72 having axially extending impeller blades 74 arranged to rotate about die central axis 48 of the evaporator unit 10. As will be apparent from the drawings, the impeller blades have a relatively narrow elongated configuration extending longitudinally generally parallel to the axis 48. The impeller member 72 is preferably made of a noncorrosive material, such as stainless steel or titanium.

The ice distribution cap 56 is formed with a concave interior which defines and encloses the ice distribution chamber 54. The distribution cap 56 is also formed with a tubular member 76 which defines an ice discharge opening 78 through which ice may exit the distribution chamber 54.

In the operation of the device of the present invention, ice formed in the freezing chamber 44 is driven upwardly by the rotating auger 46 through the slots 60 in the comminution ring 58 where the ice is fragmented before it enters the distribution chamber 54 thereby to facilitate conveying of the ice particles into the ice discharge opening 78.

As the ice passes through the slots 60 it is directed upwardly by the slotted collar 62 against the slanted annular wall 70 whereby it is diverted in a radially outward direction.

As the ice moves further into the distribution chamber 54 it is engaged by the sweeping fingers or impeller blades 74 of the rotating impeller member 72 whereby the ice has imparted thereto a force extending in a circumferential and radial direction in order to facilitate flow of the ice into the tubular member 76 and through the ice discharge opening 78. The ice distribution cap 56 is formed with an interior wall 57 having a generally circular configuration which cooperates with the blades 74 of the impeller member 72 to facilitate movement of the ice into and through the distribution opening 78.

It will be apparent that as the ice first enters the distribution chamber 54 it has had imparted thereto an axially directed force by the auger 46. However, in order for the ice to enter and pass through the discharge opening 78 it must undergo a change of direction of approximately 90°. Furthermore, if the ice is to be delivered to a remote location, flexible tubing or similar conduit means (not shown) extending to the remote location through which the ice must flow must be attached at the end of the tubular member 76 to receive the ice flowing through the discharge opening 78.

As a result of the need to change the flow direction which is imparted to the ice by the auger 46 and due to the flow resistance which is created by the flexible conduit, a reactive force is imparted to the rotating auger 46. If there are no means between the auger 46 and the discharge opening 78 to assist in changing the direction of ice flow and in overcoming the resistance which is created as a result of having to move the ice through a length of conduit, the ice will tend to accumulate above the auger 46 thereby causing jamming of the device due to the inability of the auger 46 to overcome the flow resistance thus created. As a result the entire device would have to be shut down and the accumulated ice cleared away manually.

The device of the present invention reduces the tendency for ice to accumulate above the auger 46 and thereby reduces the tendency for the device to jam and necessitate shut down.

The comminution ring 58 with the slots 60 makes it easier to move the ice through the distribution chamber 54 by reducing the size of the ice particles leaving the auger 46. The slanted surface 70 assists in diverting the ice flow from an axial direction to a radial direction in better alignment with the direction which the ice must take to pass through the discharge opening 78. After the ice passes through the comminution ring 58 and is diverted by the slanted surface 70, it is engaged by the blades 74 of the rotating impeller member 72 whereby the ice is further driven into the discharge opening 78.

It will be noted that the impeller member not only provides an added driving force to the ice, but that it does so in a direction more in line with the direction in which the ice must flow too pass through the ice discharge opening 78. Thus, the impeller member 72 not only boosts the driving force needed to move the ice out of the distribution chamber 54, but it does this in a manner which facilitates changing the direction of the ice flow leaving the end of the auger 46.

Figure 2:
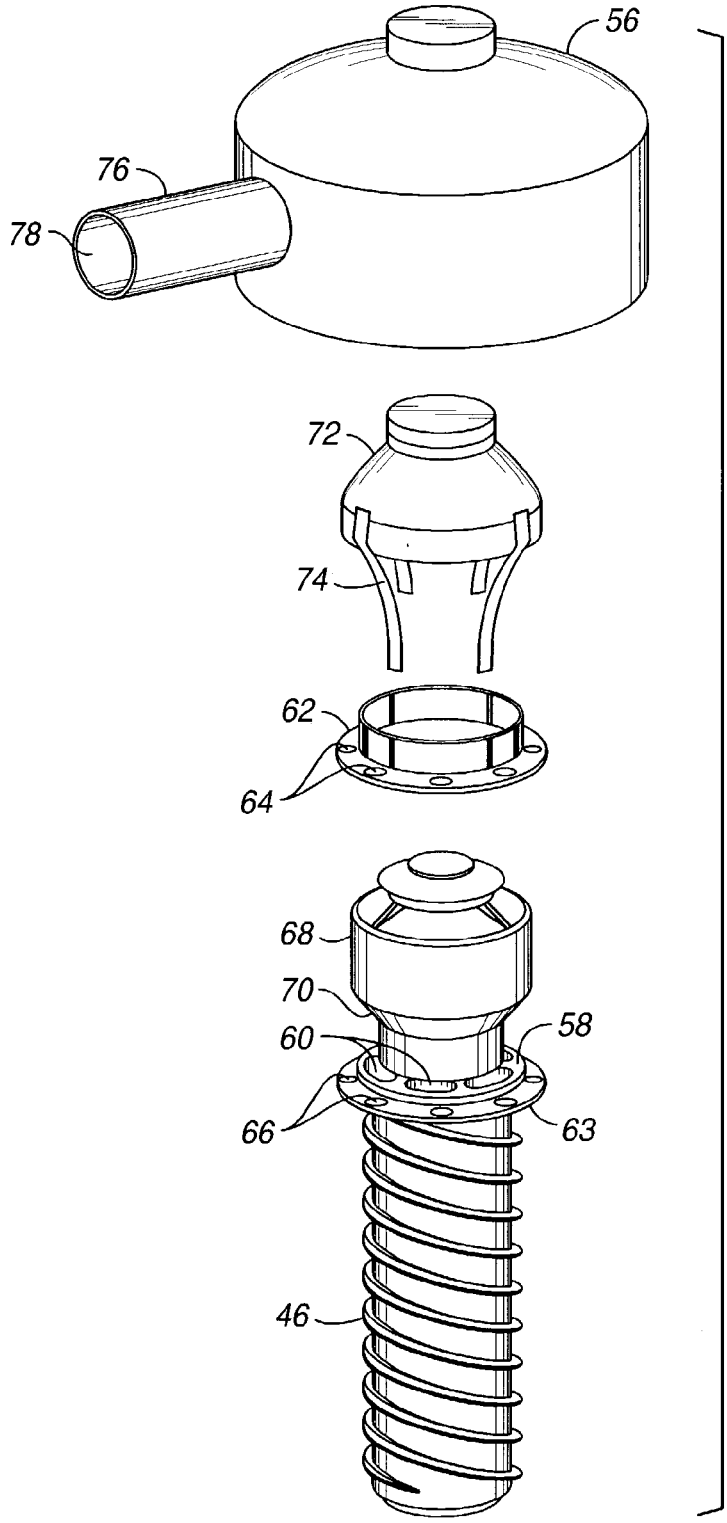
FIG. 2 is an exploded view showing in greater detail some of the parts of the evaporator unit of FIG. 1.
Figure 5:
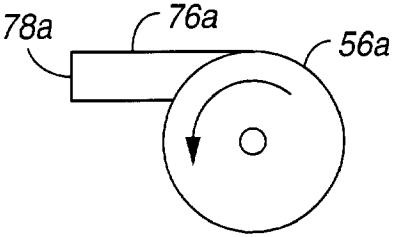
FIG. 5 is a top view of ice discharge cap in accordance with the present invention defining an ice discharge opening which extends in a circumferential direction.

In the embodiment shown in FIGS. 1 and 2, the member 76 is arranged to define the ice discharge opening 78 to extend from the distribution cap 56 in a direction radially relative to the axis 48. However, in accordance with a further embodiment of the invention, the ice discharge opening may be defined to extend tangentially relative to the direction of rotation of the impeller member 72. This embodiment is shown in FIG. 5 wherein an ice distribution cap 56*a* is formed with a tubular member 76*a* defining an ice discharge opening 78*a* extending in a direction tangential to the direction of rotation of the auger 46. This embodiment makes it easier for the ice to pass through the discharge opening 78*a* since it is in better alignment with the direction of travel imparted to the ice by the rotating blades 74 of the impeller member 72.

It should be noted that the ice distribution cap 56, 56*a* is formed with a domed configuration having a hollow interior whose wails define the distribution chamber 54 with a circular component which cooperates with the rotating impeller blades 74 to facilitate movement of the ice out of the chamber 54 and into the discharge opening 78, 78*a*.

While the present invention has been described by reference to specific embodiments thereof, it should be understood that the invention may be embodied otherwise without departing from the spirit and scope of the invention as defined in the following claims.

The invention claimed is:

1. Ice making apparatus for marine craft comprising: an evaporator unit defining a central axis and including a freezing chamber for making ice therein; an auger rotatable about said central axis within said freezing chamber for moving ice out of said freezing chamber in a direction generally parallel with said central axis; water inlet means for introducing water into said freezing chamber; a refrigeration assembly including a condenser for delivering a refrigerant fluid to said freezing chamber to effect freezing of the water introduced by said water inlet means; an ice distribution cap mounted on said evaporator unit defining an ice distribution chamber arranged to receive therein ice moved out of said freezing chamber by said rotating auger, a comminution ring arranged between said freezing chamber and said ice distribution chamber having slots formed therein to reduce the size of ice passing from said freezing chamber into said ice distribution chamber, a bearing housing located within said ice distribution chamber having operatively arranged therein an upper bearing for said rotatable auger; an annular deflection surface defined on said bearing housing for deflecting in a direction radially outwardly of said central axis ice passing through said slots in said comminution ring; a slotted circular collar located around said comminution ring for directing ice passing there through toward said annular deflection surface; an ice discharge opening formed with said ice distribution cap for directing ice out of said ice distribution chamber, said discharge opening being defined as part of said ice distribution cap to direct said ice transversely relative to said central axis; and an impeller member having impeller blades extending in a direction generally along said central axis for driving ice out of said ice distribution chamber and through said ice discharge opening.

2. Apparatus according to claim 1 wherein said ice discharge opening is defined by a tubular member formed integrally with said ice distribution cap and extending radially relative to said central axis.

3. Apparatus according to claim 1 where said ice discharge opening is defined by a tubular member formed integrally with said ice distribution cap and extending tangentially relative to the direction of rotation of said impeller member.

4. Apparatus according to claim 1 wherein rotation of said impeller blades about said central axis operates to impart to ice within said ice distribution chamber a driving force in a direction generally perpendicular to the direction of movement imparted to said ice by said auger.

5. Apparatus according to claim 1 wherein said condenser includes air cooling means operating to perform a primary cooling function for said condenser and water cooling assist means operating to intermittently provide a cooling function for said condenser when the cooling function provided by said air cooling means is insufficient.

6. Apparatus according to claim 1 wherein said ice distribution cap is detachably mounted on said evaporator unit.

7. Apparatus according to claim 1 wherein said refrigeration assembly and said evaporator unit are formed as separate structures capable of being mounted at different locations on said marine craft.

8. Apparatus according to claim 1 wherein said ice distribution cap is mounted on said evaporator unit and is formed with a domed configuration defining a generally circular interior wall cooperating with said impeller blades to facilitate movement of said ice out of said ice distribution chamber into said ice discharge opening.

9. Ice making apparatus for marine craft comprising:

evaporator means defining a central axis and including a freezing chamber for making ice therein;

auger means rotatable about said central axis within said freezing chamber for moving ice out of said freezing chamber in a direction generally parallel with said central axis;

water inlet means for introducing water into said freezing chamber;

refrigeration means including condenser means for delivering a refrigerant fluid to said freezing chamber to effect freezing of the water introduced by said water inlet means;

ice distribution means mounted on said evaporator means defining an ice distribution chamber arranged to receive therein ice moved out of said freezing chamber by said rotating auger means;

comminution means arranged between said freezing chamber and said ice distribution chamber having slots formed therein to reduce the size of ice passing from said freezing chamber into said ice distribution chamber;

a bearing housing located within said ice distribution chamber having operatively arranged therein an upper bearing for said rotatable auger means;

annular deflection means defined on said bearing housing for deflecting in a direction radially outwardly of said central axis ice passing through said slots in said comminution means;

slotted circular collar means located around said comminution means for directing ice passing there through toward said annular deflection means;

an ice discharge opening formed with said ice distribution means for directing ice out of said ice distribution chamber, said discharge opening being defined as part of said ice distribution means to direct said ice transversely relative to said central axis; and impeller means having impeller blades extending in a direction generally along said central axis for driving ice out of said ice distribution chamber and through said ice discharge opening.

10. Apparatus according to claim 9 wherein said discharge opening is arranged to direct ice in a direction extending tangentially relative to the direction of rotation of said impeller means.

11. Apparatus according to claim 9 wherein said impeller means are made of noncorrosive metal.

12. Apparatus according to claim 9 wherein said ice distribution means is formed to define said ice distribution chamber with a domed configuration with an inner wall having a circular component cooperating with said impeller means to facilitate driving of said ice through said ice discharge opening.

13. Apparatus according to claim 9 wherein said ice discharge means includes a passage defined to extend perpendicularly relative to said central axis and having said ice discharge opening at the end thereof.

14. Apparatus according to claim 9 wherein said ice distribution means is detachably mounted on said evaporator means.

15. Apparatus according to claim 9 wherein said refrigeration means and said evaporator means are formed as separate structures capable of being mounted at different locations on said marine craft.

16. Apparatus according to claim 9 wherein said condenser means includes air cooling means operating to perform a primary cooling function for said condenser means and water cooling assist means operating to intermittently provide a cooling function for said condenser means when the cooling function provided by said air cooling means is insufficient.

17. Apparatus according to claim 9 wherein rotation of said impeller means about said central axis operates to impart to ice within said ice distribution chamber a driving force in a direction generally perpendicular to the direction of movement imparted to said ice by said auger means.

18. Apparatus according to claim 9 wherein said impeller means have a narrow elongate configuration extending generally parallel to said central axis mounted within said distribution chamber rotatable about said central axis for driving ice through said discharge opening.

19. Apparatus according to claim 1 wherein said impeller blades have a narrow elongate configuration extending generally parallel to said central axis mounted within said distribution chamber rotatable about said central axis for driving ice through said discharge means.

* * * * *